US005316500A

United States Patent [19]

Vanaleck et al.

[11] Patent Number: 5,316,500

[45] Date of Patent: May 31, 1994

[54] FASTENER FOR A PRINTED CIRCUIT BOARD MOUNTED CONNECTOR

[75] Inventors: John T. Vanaleck; Alan L. Roath, both of Madison, Ohio

[73] Assignee: Ohio Associated Enterprises, Inc., Painesville, Ohio

[21] Appl. No.: 2,659

[22] Filed: Jan. 11, 1993

[51] Int. Cl.[5] ..... H01R 13/73

[52] U.S. Cl. ..... 439/567; 439/571; 411/45; 411/60

[58] Field of Search ..... 439/567, 571, 573; 411/60, 41, 61, 48, 45

[56] References Cited

U.S. PATENT DOCUMENTS

| | | | |
|---|---|---|---|
| 2,845,832 | 8/1958 | Olson | 411/45 |
| 4,548,534 | 10/1985 | Trummer | 411/61 |
| 4,871,289 | 10/1989 | Choiniere | 411/60 |
| 4,907,987 | 3/1990 | Douty et al. | 439/567 |
| 5,065,490 | 11/1991 | Wivagg et al. | 411/60 |
| 5,080,611 | 1/1992 | Hypes | 439/567 |

FOREIGN PATENT DOCUMENTS

| | | | |
|---|---|---|---|
| 1233661 | 2/1967 | Fed. Rep. of Germany | 411/60 |

*Primary Examiner*—Gary F. Paumen

*Attorney, Agent, or Firm*—Watts, Hoffmann, Fisher & Heinke Co.

[57] ABSTRACT

A fastener for securing a connector body over a hole in a printed circuit board comprises a clip rigidly supported by the connector body and a wedge supported by the connector body for sliding movement along the clip. In one form, the clip includes a pair of resilient arms having free ends extending outside the body. The resilient arms have teeth or other means near their free ends for engaging the inner surfaces of the hole. The arms converge toward each other near their free ends to retract the teeth when the arms are in an unengaged condition. The wedge includes a portion which extends between the arms for spreading the arms and teeth as the wedge slides along the clip toward the free ends of the arms. The fastener is secured in the hole by inserting the clip arms into the hole and pressing the wedge into the hole toward the free ends of the arms. Advantages of the fastener include no protrusion through the opposite surface of the board, low insertion force and relative insensitivity to tolerance stack-ups.

6 Claims, 3 Drawing Sheets

FASTENER FOR A PRINTED CIRCUIT BOARD MOUNTED CONNECTOR

FIELD OF THE INVENTION

This invention relates generally to the field of printed circuit board mounted electrical connectors, and more specifically to fasteners for positioning and retaining such conductors on printed circuit boards.

BACKGROUND OF THE INVENTION

It is known to couple electrical signals to printed circuit boards by means of permanently mounted connectors fastened and soldered to a surface of the board. Such permanently-mounted connectors include electrically insulative bodies supporting electrically conductive solder tails through which the signals are carried. According to one technique, the connector bodies are positioned and fastened to the board with the solder tails positioned over pads on the surface of the board which are coated with solder paste. The solder paste is then "reflowed," that is, heated. When the solder cools, electrically conductive joints are formed between the solder tails and the pads to conduct signals to and from the board.

The fasteners holding the connector body against the board must perform two tasks. The fasteners must hold the solder tails in position against the pads during solder reflow, and resist board distortion and connector movement so that reliable solder joints form between the tails and pads. The fasteners also provide strain relief to protect the solder joints from breaking due to external forces such as those due to handling.

Proposed fasteners for holding connector bodies against the surface of a printed circuit board include screws, rivets, non-metallic posts and plastic snap fit pegs. One drawback to these styles of fasteners is that, in order to develop sufficient retention force, they must pass through a hole in the board and protrude through the surface opposite that on which the connector body is mounted. For example, one style of non-metallic post is passed through a hole in the surface of the board and "staked," or deformed, to form a plug on the opposite surface. The protrusion of such fasteners through the opposite surface of the board increases the thickness of the board-mounted circuit and limit their usefulness on low-profile applications.

Another proposed style of fastener is a non-metallic post which is press fit into a hole in the board. Unlike those previously discussed, press fit fasteners need not protrude through the opposite surface of the board. Unfortunately, these press fit fasteners require an excessive insertion force which may preclude their insertion by hand tools. Furthermore, such fasteners are very sensitive to tolerance stack-ups between the hole diameter and the fastener diameter. There remains a need for a fastener with sufficient retention force to hold a printed circuit board mounted connector without protruding through the opposite surface of the board or requiring an excessive insertion force.

DISCLOSURE OF THE INVENTION

A fastener for securing a connector body over a hole in a printed circuit board comprises a clip rigidly supported by the connector body and a wedge supported by the connector body for sliding movement along the clip. In one form, the clip includes a pair of resilient arms having free ends extending outside the body. The resilient arms have teeth or other means near their free ends for engaging the inner surfaces of the hole. The arms converge toward each other near their free ends to retract the teeth when the arms are in an undeformed condition.

The wedge includes a portion which extends between the arms for spreading the arms and teeth as the wedge slides along the clip toward the free ends of the arms. In one form, the wedge is a strip of metal including a portion bent obliquely or normally to the clip and extending between the arms for transverse abutment therewith.

The fastener is secured in the hole by inserting the clip arms into the hole and pressing the wedge into the hole toward the free ends of the arms. Prior to installation, the clip is in its unengaged condition with the resilient arms converging toward each other near their free ends so that they may be easily inserted and removed from the hole. When the fastener is installed and the wedge is pressed toward the free ends of the arms, the tongue presses outwardly on the arms tending to spread them toward the sides of the hole. As the arms are spread, the teeth or other means on the free ends of the arms engage the sides of the hole to retain the arms in the hole. Since the teeth engage the inner surface of the hole to secure the connector body against the board, the fastener need not protrude through the opposite surface of the board. Since the arms are spread by the wedge to engage the sides of the hole, the fastener is less sensitive to tolerance stack-up between the fastener and the hole than a non-metallic post press fit into the same hole would be.

The fastener has a very small insertion force, yet produces a significant retention force. The retention force is maximized when the wedge is held in place after it is pressed toward the free ends of the arms. In one form, the wedge includes outwardly-projecting barbs which prevent the wedge from sliding along the clip in the direction away from the free ends of the arms. Furthermore, clip includes a frame supporting the arms which mounts a strip of solder along its surface facing the wedge. After installation of the fastener, the barbs on the wedge serve to hold the wedge in place so that the clip and wedge are secured together by the solder mounted on the clip during the solder reflowing operation.

Still other features and advantages and a full understanding of the invention will become apparent to those skilled in the art from the following description of the preferred embodiment of the invention and the accompanying drawings.

DETAILED DESCRIPTION OF THE PREFERRED EMBODIMENT

Figure 6:
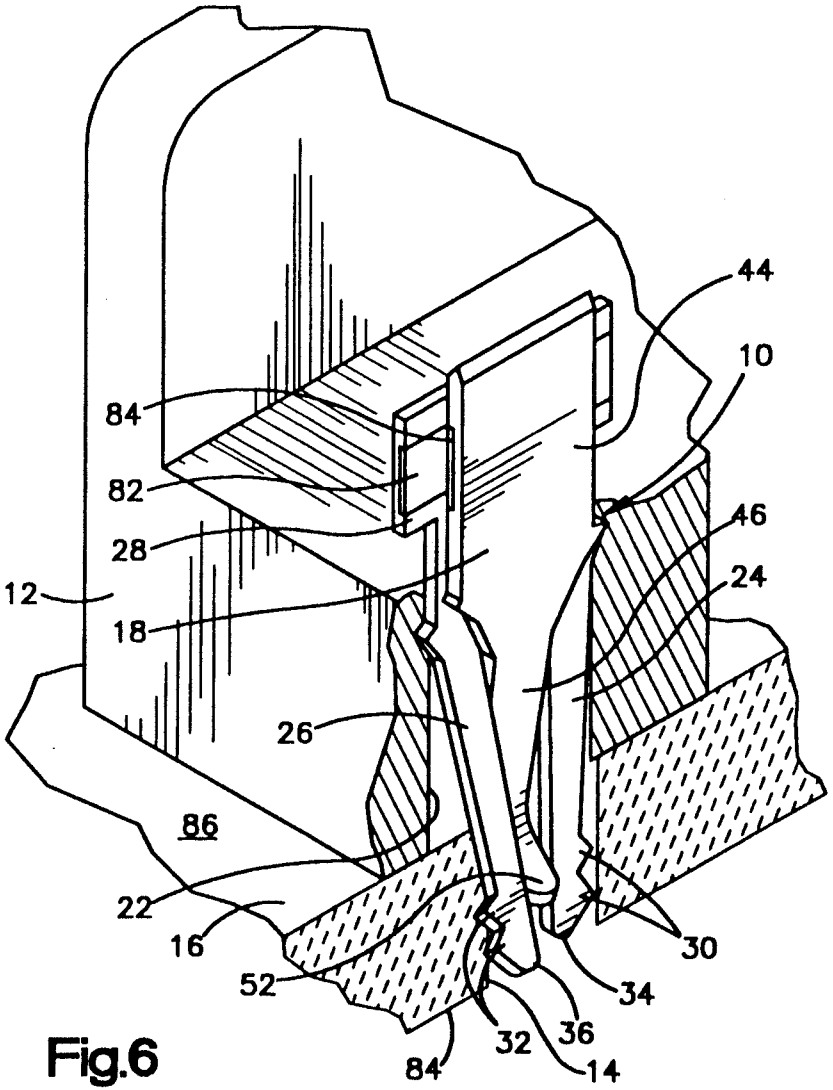
FIG. 6 is a perspective view of the fastener of FIGS. 1 and 2 in an engaged condition with the connector body broken away to show the fastener.
Figure 1:
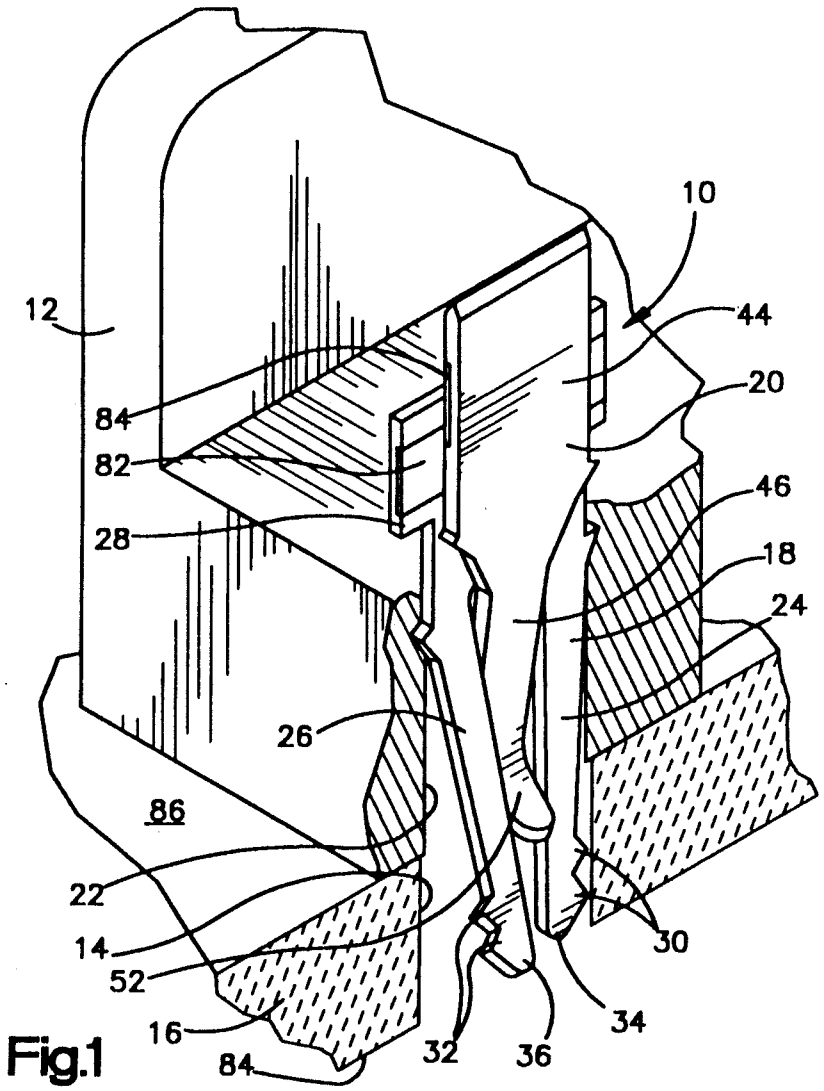
FIG. 1 is a perspective view of a fastener in an undeformed condition supported in a connector body which is broken away to show the fastener.
Figure 2:
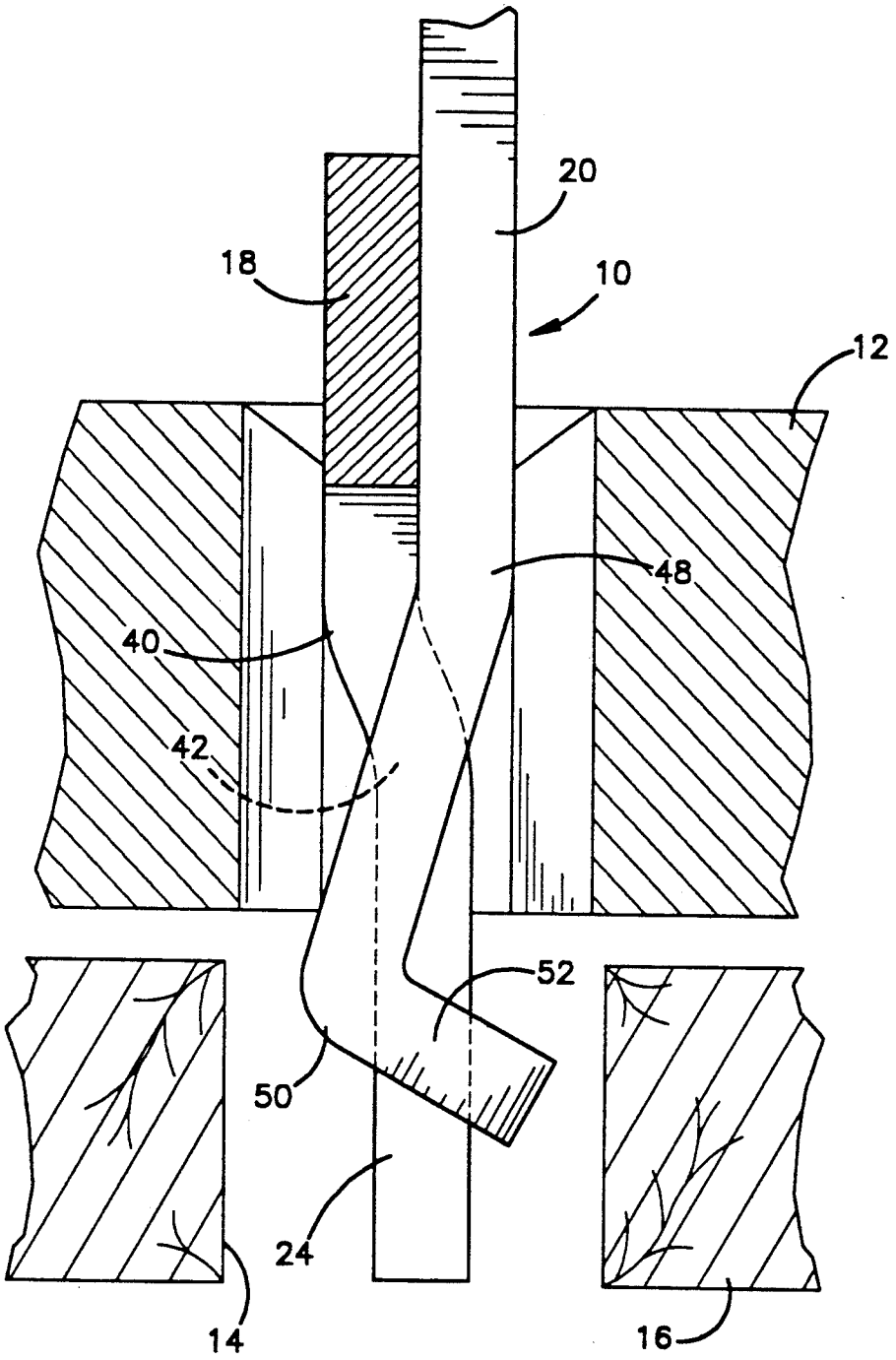
FIG. 2 is an elevational view of the fastener of FIG. 1.

FIGS. 1, 2 and 6 show a fastener 10 for securing a connector body 12 over a hole 14 in a printed circuit board 16. The fastener 10 comprises a clip 18 and a wedge 20 supported in a passage 22 in the connector body 12. The clip 18 is fixed relative to the connector body 12 while the wedge 20 is permitted to slide in the passage 22 along the clip 18. The sliding movement of the clip 18 along the wedge 20 causes a deformation of the clip 18 which anchors the fastener 10 in the hole 14.

Figure 3:
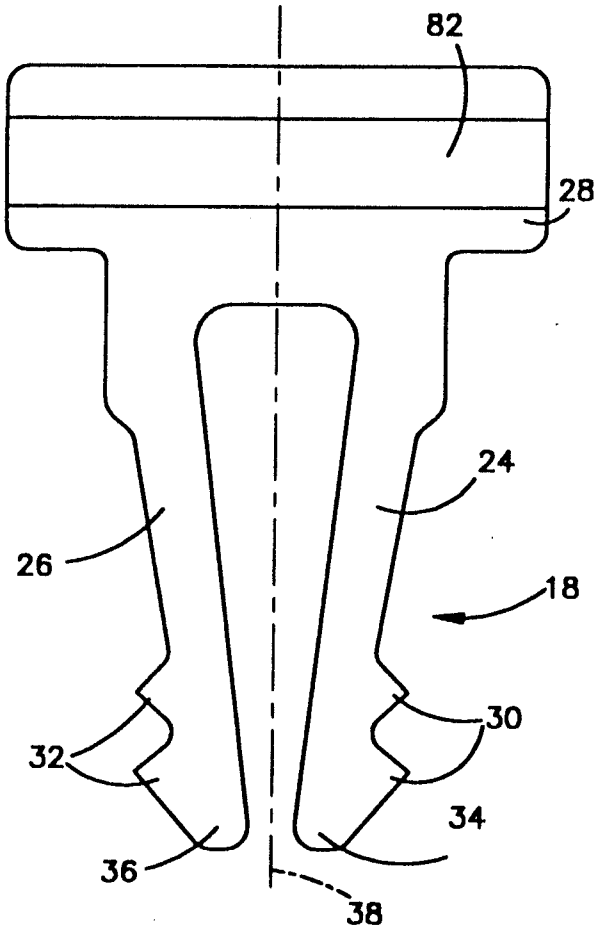
FIG. 3 is an elevational view of a clip for use in the fastener of FIGS. 1 and 2.

The clip 18, shown in an undeformed condition in FIG. 3, is a metal stamping which includes two arms 24, 26 extending from a frame 28. Teeth 30, 32 project outwardly near free ends 34, 36 of the arms 24, 26. The arms 24, 26 converge toward their free ends 34, 36 at angles of approximately 7° relative to a central axis 38 of the clip 18 in order to retract the teeth 30, 32 for insertion in the hole 14. As best shown in FIG. 2, bends 40, 42 (only one arm shown) are provided to raise the free ends 34, 36 of the arms 24, 26 out of the plane of the frame 28 toward the wedge 20.

Figure 4:
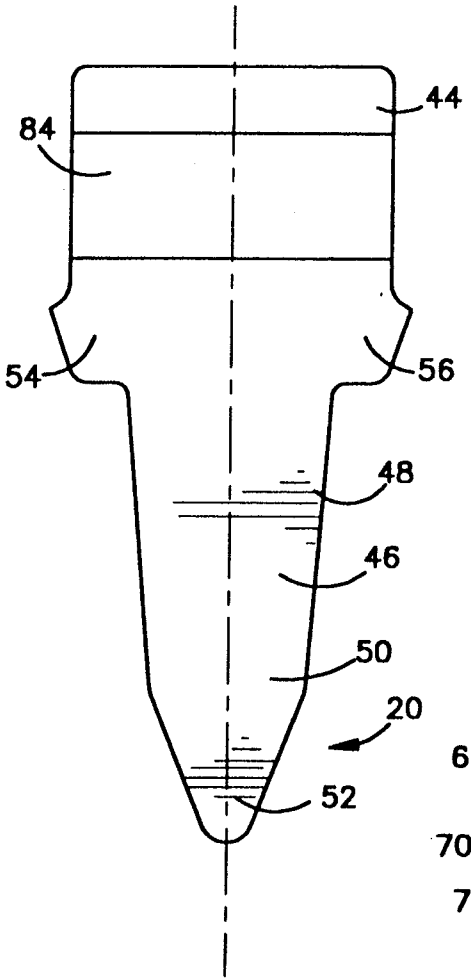
FIG. 4 is an elevational view of a wedge for use in the fastener of FIGS. 1 and 2.

The wedge 20, shown in FIG. 4, is a metal stamping in the form of a strip of metal with a head 44 and a depending finger 46. The finger 46 is bent twice at 48, 50 (FIG. 2) so that an abutting portion 52 of the finger 46 extends obliquely between the arms 24, 26 for transverse abutment therewith. Barbs 54, 56 project from opposite sides of the head 44 for engagement with sides of the passage 22 in the connector body 12 to restrain the clip against sliding motion along the clip 18 in a direction away from the free ends 34, 36 of the clip 18. The finger 46 is tapered inwardly in the direction along its central axis 58 opposite the head 44 at an angle less than the internal angle of the arms 24, 26 relative to the central axis 38 of the clip 18 (that is, less than the 7° angle shown in FIG. 3) to facilitate engagement between the abutting portion 52 of the finger 46 and the arms 24, 26.

Figure 5:
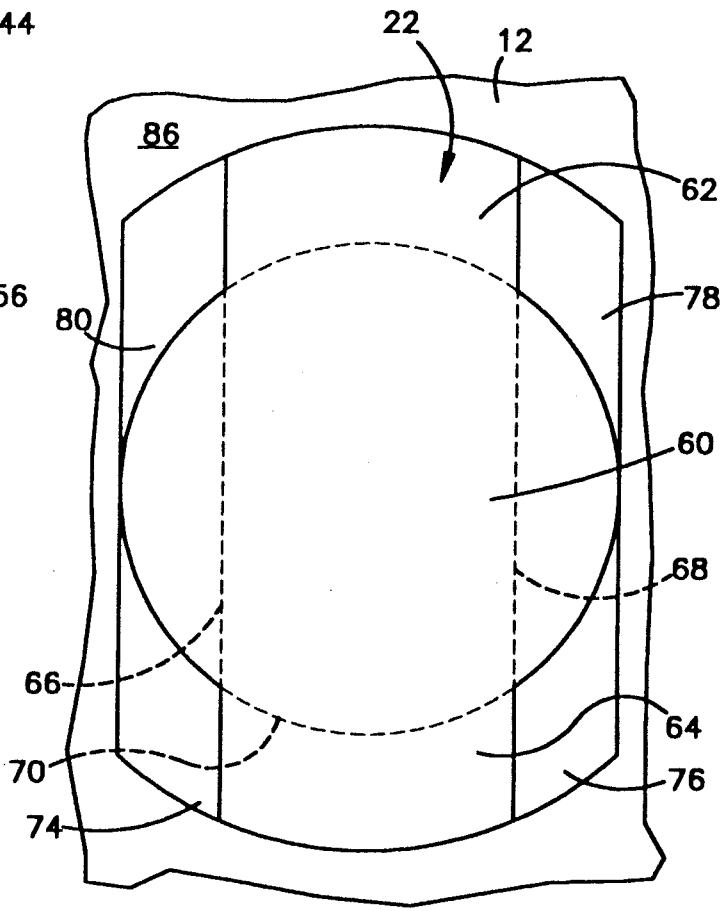
FIG. 5 is a plan view of a portion of a surface of the connector body taken along the direction 5—5 in FIG. 1 with the fastener removed.

The clip 18 and wedge 20 engage the connector body 12 through the passage 22. As shown in FIGS. 1, 2 and 5, the passage 22 extends through the connector body 12 and includes a central portion 60 of cylindrical cross-section and two portions 62, 64 on diametrically opposite sides of the central portion 60 defined by planes 66, 68 and arcuate surfaces of a cylinder 70. Side portions of the clip 18 and wedge 20 are retained in the portions 62, 64 of the passage 22. The mouth of the passage 22 on the surface 72 of the connector body 12 opposite the board 16 is tapered inwardly as at 74, 76, 78, 80 to ease the insertion of the clip 18 and the wedge 20.

Prior to engagement with the hole 14, the clip 18 and wedge 20 are supported in the passage 22 with the clip 18 in an undeformed condition. The frame 28, which is wider than the passage 22, abuts the surface 72 of the connector body 12 to fix the clip 18 against movement into the passage 22. The wedge 20 is supported against the clip 18 with the finger 46 of the wedge 20 extending into the space between the arms 24, 26 of the clip 18. The barbs 54, 56 on the sides of the wedge 20 engage the sides of the inner surface of the passage 22 to retain the wedge in the passage 22. The abutting portion 52 of the wedge 20 abuts against the inner surfaces of the arms 24, 26 and help to retain the undeformed clip 18 in the passage 22. (Additional barbs, not shown in the drawings, may be provided on the outer sides of the frame 28 or arms 24, 26 to further secure the clip 18 in the passage 22.)

The fastener 10 is engaged by positioning the free ends 34, 36 of the arms 24, 26 in the hole 14 and pressing on the head 44 of the wedge 20 with a hand tool to slide the wedge 20 along the clip 18 into the passage 22. As the wedge 20 slides along the clip 18 into the passage 22, the abutting portion 52 moves toward the free ends 34, 36 of the arms 24, 26. Since the arms 24, 26 converge toward their free ends 34, 36, movement of the abutting portion 52 toward the free ends 34, 36 deforms and spreads the arms 24, 26 to engage the teeth 30, 32 with the inner surface of the hole 14 as shown in FIG. 6. As the wedge 20 slides into the passage 22, the barbs 54, 56 continue to engage the inner surface of the passage 22 to restrain the wedge 20 against movement in the opposite direction out of the passage 22.

The frame 28 of the clip 18 includes a solder inlay 82 for coupling the clip 18 and wedge 20 during the solder reflow operation. The solder inlay 82 restrains the wedge 20 against further movement along the clip 18 engages the inner surface of the hole 14. The barbs 54, 56 serve to position the wedge 20 along the clip 18 during the solder reflow operation.

Since the teeth 30, 32 are retracted when the fastener 10 is inserted in the hole 14, the insertion force is small. On the other hand, the engagement of the arms 24, 26 and teeth 30, 32 with the inner surface of the hole 14 results in a significant retention force. Since the fastener 10 engages the inner surface of the hole, the arms 24, 26 may be sized so as not to protrude through the surface 84 of the board 16 opposite the surface 86 of the board on which the connector body 12 is mounted. In addition, since the degree to which the arms 24, 26 are spread may be varied by varying the degree to which the wedge 20 is pressed into the passage 22, the fastener is relatively insensitive to tolerance stack-up between the fastener 10 and the hole 14.

Many variations and modifications of the invention will be apparent to those skilled in the art from the above detailed description. Therefore, it is to be understood that, within the scope of the appended claims, the invention can be practiced otherwise than as specifically shown and described.

We claim:

1. A fastener for securing a connector body over a hole in a printed circuit board comprising:

a) a clip fixed in the body including a pair of resilient arms extending beyond the body having engagement means near free ends of the arms for engaging the inner surfaces of the hole, wherein the arms converge in an unengaged condition toward each other near their free ends to retract the engagement means from contact with the hole; and b) a wedge supported by the body for sliding non-rotational motion along the clip toward the free ends of the arms, including a portion extending between the arms for spreading the arms and engagement means as the wedge slides toward the free ends of the arms to engage the clip with an inner surface of the hole.

2. The fastener of claim 1 wherein the clip includes a frame integral with the arms.

3. The fastener of claim 1 wherein the engagement means are teeth projecting from the arms near their free ends.

4. The fastener of claim 1 wherein the wedge is a strip of metal including a portion bent obliquely or normally to the clip and extending between the arms for transverse abutment with the arms.

5. The fastener of claim 1 wherein the wedge includes barbs for restraining the wedge against sliding motion away from the free ends of the arms.

6. The fastener of claim 1 wherein one of the wedge and the clip carries coupling means to fix the position of the wedge relative to the clip once the arms and engagement means of the clip have been spread by the wedge.

* * * * *

UNITED STATES PATENT AND TRADEMARK OFFICE

CERTIFICATE OF CORRECTION

PATENT NO. : 5,316,500

DATED : May 31, 1994

INVENTOR(S) : John T. Venaleck, et al:

It is certified that error appears in the above-indentified patent and that said Letters Patent is hereby corrected as shown below:

On the title page, item (75): Inventors shuld read--John T. Venaleck--.

Item (19): should read --Venaleck--.

Signed and Sealed this

Thirtieth Day of August, 1994

*Attest:*

*Attesting Officer*

BRUCE LEHMAN

*Commissioner of Patents and Trademarks*